US008720595B2

(12) United States Patent
Sulzer

(10) Patent No.: US 8,720,595 B2
(45) Date of Patent: May 13, 2014

(54) DEPTH LIMITING OF RIPPER ATTACHMENT BY ELECTRONICALLY LIMITING CYLINDER LENGTH

(75) Inventor: Bryan D Sulzer, Dubuque, IA (US)

(73) Assignee: Deere & Company, Moline, IL (US)

( * ) Notice: Subject to any disclaimer, the term of this patent is extended or adjusted under 35 U.S.C. 154(b) by 402 days.

(21) Appl. No.: 13/164,498

(22) Filed: Jun. 20, 2011

(65) Prior Publication Data

US 2012/0318540 A1 Dec. 20, 2012

(51) Int. Cl.
*A01B 63/111* (2006.01)

(52) U.S. Cl.
USPC ..... 172/4

(58) Field of Classification Search
USPC ..... 172/2, 4, 4.5, 7, 9; 37/347, 348; 701/50; 414/11, 525.54, 549, 699, 789.7
See application file for complete search history.

(56) References Cited

U.S. PATENT DOCUMENTS

| | | | |
|---|---|---|---|
| 4,031,964 | A | 6/1977 | Takahashi |
| 4,044,838 | A | 8/1977 | Wooldridge |
| 4,120,364 | A | 10/1978 | Wooldridge |
| 4,159,474 | A | 6/1979 | Wooldridge |
| 5,685,377 | A | 11/1997 | Arstein et al. |
| 5,950,141 | A | 9/1999 | Yamamoto et al. |
| 6,230,107 | B1 | 5/2001 | Yamamoto et al. |
| 6,612,375 | B2 | 9/2003 | Rogala |

*Primary Examiner* — Robert Pezzuto
(74) *Attorney, Agent, or Firm* — Stephen F. Rost; Anthony P. Filomena; Taft Stettinius & Hollister LLP

(57) ABSTRACT

A ripper depth limit system and method that includes a lift input for operator controls to raise and lower the ripper, a depth limit input, a lift sensor input that senses the ripper lift cylinder position, and a controller that processes the inputs to generate, execute and revise ripper lift cylinder commands that keep the ripper above the ripper depth limit. The depth limit input can select the ripper depth limit from a plurality of predefined depth limits, or between minimum and maximum ripper depths, or by some other method. The ripper depth limit system can also include a pitch input for operator controls of ripper pitch, and a pitch sensor that senses ripper pitch cylinder position, and the controller can process the pitch inputs to generate, execute and revise ripper pitch and lift cylinder commands that keep the ripper above the ripper depth limit.

20 Claims, 4 Drawing Sheets

DEPTH LIMITING OF RIPPER ATTACHMENT BY ELECTRONICALLY LIMITING CYLINDER LENGTH

FIELD OF THE INVENTION

This present invention generally relates to an automatic control system for a ripper used on construction equipment, and more specifically to automatically controlling ripper depth.

BACKGROUND OF THE INVENTION

Typically a ripper mounted on construction equipment such as a tractor is manually controlled by the operator who raises or lowers the ripper shank or varies the ripper pitch based upon experience, ground conditions, vehicle speed and other working conditions. Ripper depth is typically adjusted by removing a pin from the ripper shank and repositioning the shank relative to the ripper carrier and reinserting the pin. This effectively changes the length and potential depth of the ripper. This naturally requires operator time to reposition the ripper using the pin, and requires considerable skill and experience on the part of the operator to determine the desired depth to minimize the changes that need to be made to ripper length.

SUMMARY

A system is disclosed that limits the depth of a ripper mounted to a tractor by electronically sensing the lift cylinder length and limiting that length in order to limit the depth of ripper engagement with the ground.

A ripper depth limit system is disclosed for a ripper that includes a ripper lift cylinder. The ripper depth limit system includes an operator lift input, an operator ripper depth limit input, a lift cylinder sensor coupled to the ripper lift cylinder and a ripper electro-hydraulic controller. The operator lift input generates an operator lift signal that controls the raising and lowering of the ripper. The operator ripper depth limit input sets a ripper depth limit. The lift cylinder sensor senses the position of the ripper lift cylinder and generates a lift cylinder position signal. The ripper electro-hydraulic controller processes the operator lift signal, the lift cylinder position signal and the ripper depth limit; and generates and outputs ripper lift cylinder commands that do not allow the ripper depth to exceed the ripper depth limit. The ripper electro-hydraulic controller can include a position processor for determining a ripper position based on the lift cylinder position signal, where the position processor provides the ripper position for further processing by the ripper electro-hydraulic controller.

The operator ripper depth limit input can include an activation control for activating the ripper depth limit function, and a depth setting for setting the ripper depth limit. The operator ripper depth limit input can include a selector for selecting the ripper depth limit from a plurality of predefined depth limits. Alternatively, the operator ripper depth limit input can include a selector for selecting the ripper depth limit between a minimum ripper depth and a maximum ripper depth.

The ripper lift cylinder commands can be output to a ripper lift spool valve controlling the raising and lowering of the ripper. The ripper lift cylinder commands can be output to an output conditioning processor, and the output conditioning processor can output the conditioned ripper lift cylinder commands to a ripper lift spool valve controlling the raising and lowering of the ripper.

The ripper depth limit system can also include an operator pitch input, and a pitch cylinder sensor coupled to a ripper pitch cylinder, where he operator pitch input generates an operator pitch signal for controlling the pitch of the ripper; and the pitch cylinder sensor senses the position of the ripper pitch cylinder and generates a pitch cylinder position signal. The ripper electro-hydraulic controller can also process the operator pitch signal and the pitch cylinder position signal to generate and output ripper pitch cylinder commands that do not allow the ripper depth to exceed the ripper depth limit. The ripper pitch cylinder commands can be output to a ripper pitch spool valve controlling the pitch of the ripper. The ripper pitch cylinder commands can be output to an output conditioning processor that outputs conditioned ripper pitch cylinder commands to a ripper pitch spool valve controlling the pitch of the ripper. The ripper electro-hydraulic controller can include a position processor for determining a ripper position based on the lift and pitch cylinder position signals.

A ripper depth limit method is disclosed for controlling a ripper coupled to a lift cylinder that raises and lowers the ripper. The ripper depth limit method includes setting a ripper depth limit, reading a lift cylinder position from a sensor coupled to the lift cylinder, determining a ripper position using the lift cylinder position reading, receiving a ripper lift cylinder command from an operator control device, and determining whether executing the ripper lift cylinder command will cause the ripper to exceed the ripper depth limit. When the ripper lift cylinder command will not cause the ripper to exceed the ripper depth limit, the method includes executing the ripper lift cylinder command. When the ripper lift cylinder command will cause the ripper to exceed the ripper depth limit, the method includes revising the ripper lift cylinder command to not cause the ripper to exceed the ripper depth limit and executing the revised ripper lift cylinder command. The method then includes returning to receive another ripper lift cylinder command.

After the determining a ripper position step and before the receiving a ripper lift command step, the ripper depth limit method can include determining whether the ripper position exceeds the ripper depth limit; and when it exceeds the ripper depth limit, generating a ripper lift command to raise the ripper to the ripper depth limit. After the receiving a ripper lift cylinder command step, the ripper depth limit method can include determining whether the ripper depth limit functionality is still activated; and when it is not still activated, executing the ripper lift cylinder command and exiting the ripper depth limit method.

Setting a ripper depth limit can include reading one of a plurality of predefined depth limit values from a depth limit selector. Alternatively, setting a ripper depth limit can include determining a position of a selector between a minimum and maximum value, and determining the ripper depth limit based on the position of the selector.

A ripper depth limit method is disclosed for controlling a ripper coupled to a lift cylinder that raises and lowers the ripper and a pitch cylinder the controls the pitch of the ripper. The ripper depth limit method includes setting a ripper depth limit, reading a lift cylinder position from a lift sensor coupled to the lift cylinder, reading a pitch cylinder position from a pitch sensor coupled to the pitch cylinder, determining a ripper position using the lift and pitch cylinder position readings, receiving a ripper lift or pitch cylinder command from an operator control device, and determining whether executing the ripper lift or pitch cylinder command will cause the ripper to exceed the ripper depth limit. When the ripper lift or pitch cylinder command will not cause the ripper to exceed the ripper depth limit, the method includes executing the ripper lift or pitch cylinder command. When the ripper lift or pitch cylinder command will cause the ripper to exceed the ripper depth limit, the method includes revising the ripper lift or pitch cylinder command to not cause the ripper to exceed the ripper depth limit and executing the revised ripper lift or pitch cylinder command. The method then includes returning to receive another ripper lift or pitch cylinder command.

After the determining a ripper position step and before the receiving a ripper lift or pitch cylinder command step, the ripper depth limit method can include determining whether the ripper position exceeds the ripper depth limit, and when it exceeds the ripper depth limit, generating a ripper lift command to raise the ripper to the ripper depth limit. After the receiving a ripper lift or pitch cylinder command step, the ripper depth limit method can include determining whether the ripper depth limit functionality is still activated, and when it is not still activated, executing the ripper lift or pitch cylinder command and exiting the ripper depth limit method.

The step of revising the ripper lift or pitch cylinder command to not cause the ripper to exceed the ripper depth limit can include: for a ripper lift cylinder command, revising the ripper lift cylinder command to lower the ripper to the ripper depth limit only; and for a ripper pitch cylinder command, generating and executing a ripper lift cylinder command to raise the ripper and executing the ripper pitch cylinder command so the ripper does not exceed the ripper depth limit.

DETAILED DESCRIPTION

Figure 1:
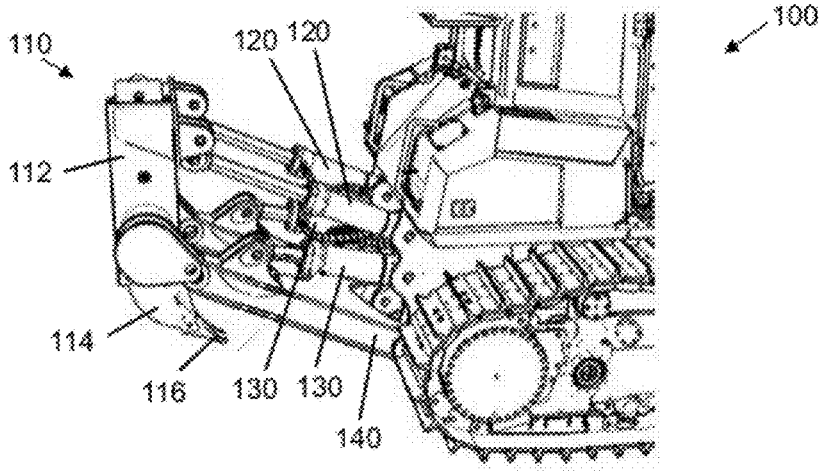
FIG. 1 illustrates an exemplary embodiment of a ripper coupled to a crawler.

For the purposes of promoting an understanding of the principles of the novel invention, reference will now be made to the embodiments described herein and illustrated in the drawings and specific language will be used to describe the same. It will nevertheless be understood that no limitation of the scope of the novel invention is thereby intended, such alterations and further modifications in the illustrated devices and methods, and such further applications of the principles of the novel invention as illustrated therein being contemplated as would normally occur to one skilled in the art to which the novel invention relates.

A system is disclosed that limits the depth of a ripper attached to a crawler by electronically sensing the lift cylinder length and limiting that length in order to limit the depth of ripper engagement with the ground. The system can include electro-hydraulic (EH) valves, a microprocessor, an operator input device, and a sensor for sensing the length of at least one of the ripper carrier lift cylinders. When the operator commands a ripper lower function, a limiting function can be used to limit the minimum length of the ripper cylinder to either a predefined or custom defined length which effectively limits the ripper engagement depth.

FIG. 1 illustrates an exemplary embodiment of a ripper 110 coupled to a crawler 100. The ripper 110 includes a shank holder 112, a ripper shank 114 with a tip 116, a pair of ripper pitch cylinders 120, a pair of ripper lift cylinders 130 and a pair of links 140. The proximal ends of the ripper pitch cylinders 120, the ripper lift cylinders 130 and the links 140 are coupled to the crawler 100 and the distal ends of the ripper pitch cylinders 120, the ripper lift cylinders 130 and the links 140 are coupled to the shank holder 112. The ripper lift cylinders 130 can be extended and retracted to raise and lower the ripper 114. The pair of ripper pitch cylinders 120 can be extended and retracted to change the pitch of the ripper 114. The ripper shank 114 can be manually raised or lowered in the shank holder 112.

Figure 2:
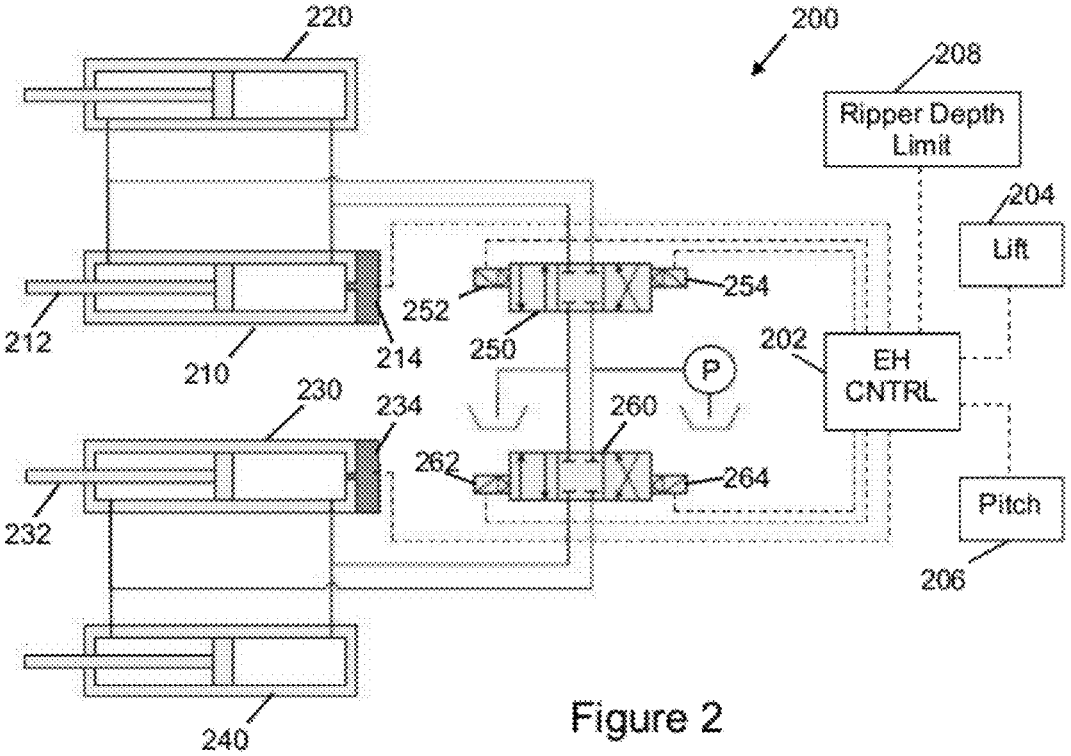
FIG. 2 illustrates an exemplary electro-hydraulic (EH) system for controlling a ripper.

FIG. 2 illustrates an exemplary electro-hydraulic (EH) system 200 for controlling a ripper. The EH system 200 includes a ripper EH controller 202, a lift spool valve 250, a pitch spool valve 260, a pair of lift cylinders 210, 220, a pair of pitch cylinders 230, 240, a flow source P and a sink. The ripper EH controller 202 receives operator and system inputs and generates output signals to control the spool valves and cylinders.

The ripper EH controller 202 receives operator inputs from a ripper lift controller 204, a ripper pitch controller 206 and a ripper depth limit controller 208. The ripper lift and pitch controllers 204, 206 can be any of various types of controllers known in the art, for example a single joystick for both lift and pitch control, or separate joysticks for each of lift and pitch control. The ripper depth limit controller 208 can also be of various types of controllers, for example a switch, knob, button, menu, etc. The ripper EH controller 202 processes the operator inputs to control the ripper.

At least one of the ripper lift cylinders 210, 220 has a lift cylinder position sensor 214. The lift cylinder position sensor 214 senses the position of the piston 212 in the lift cylinder 210 and sends a sensor output to the ripper EH controller 202. The ripper EH controller 202 can use the output of the lift cylinder position sensor 214 to determine the position of the ripper relative to the main geometry of the tractor.

One of the ripper pitch cylinders 230, 240 can have a pitch cylinder position sensor 234. The pitch cylinder position sensor 234 senses the position of the piston 232 in the pitch cylinder 230 and sends a sensor output to the ripper EH controller 202. The ripper EH controller 202 can use the output of the pitch cylinder position sensor 234 to more accurately determine the position of the ripper relative to the main geometry of the tractor. As shown below, it is optional to include position sensors on the pitch cylinders for the ripper depth limiting system.

The ripper EH controller 202 processes the operator and sensor inputs and sends control signals to the lift spool valve 250 and the pitch spool valve 260. The lift spool valve 250 includes a first movement actuator 252 and a second movement actuator 254 to move the lift spool valve 250 to a desired position. The lift spool valve 250 also includes an input side (bottom) coupled to a flow source P, for example a pump, and an output side (top) coupled to the lift cylinders 210, 220. The first movement actuator 252 can be used to move the lift spool valve 250 to retract the lift cylinders 210, 220. The second movement actuator 254 can be used to move the lift spool valve 250 to extend the lift cylinders 210, 220.

The pitch spool valve 260 includes a first movement actuator 262 and a second movement actuator 264 to move the pitch spool valve 260 to a desired position. The pitch spool valve 260 also includes an input side (top) coupled to a flow source P, for example a pump, and an output side (bottom) coupled to the pitch cylinders 230, 240. The first movement actuator 262 can be used to move the pitch spool valve 260 to retract the pitch cylinders 230, 240. The second movement actuator 264 can be used to move the pitch spool valve 260 to extend the pitch cylinders 230, 240.

Figure 3:
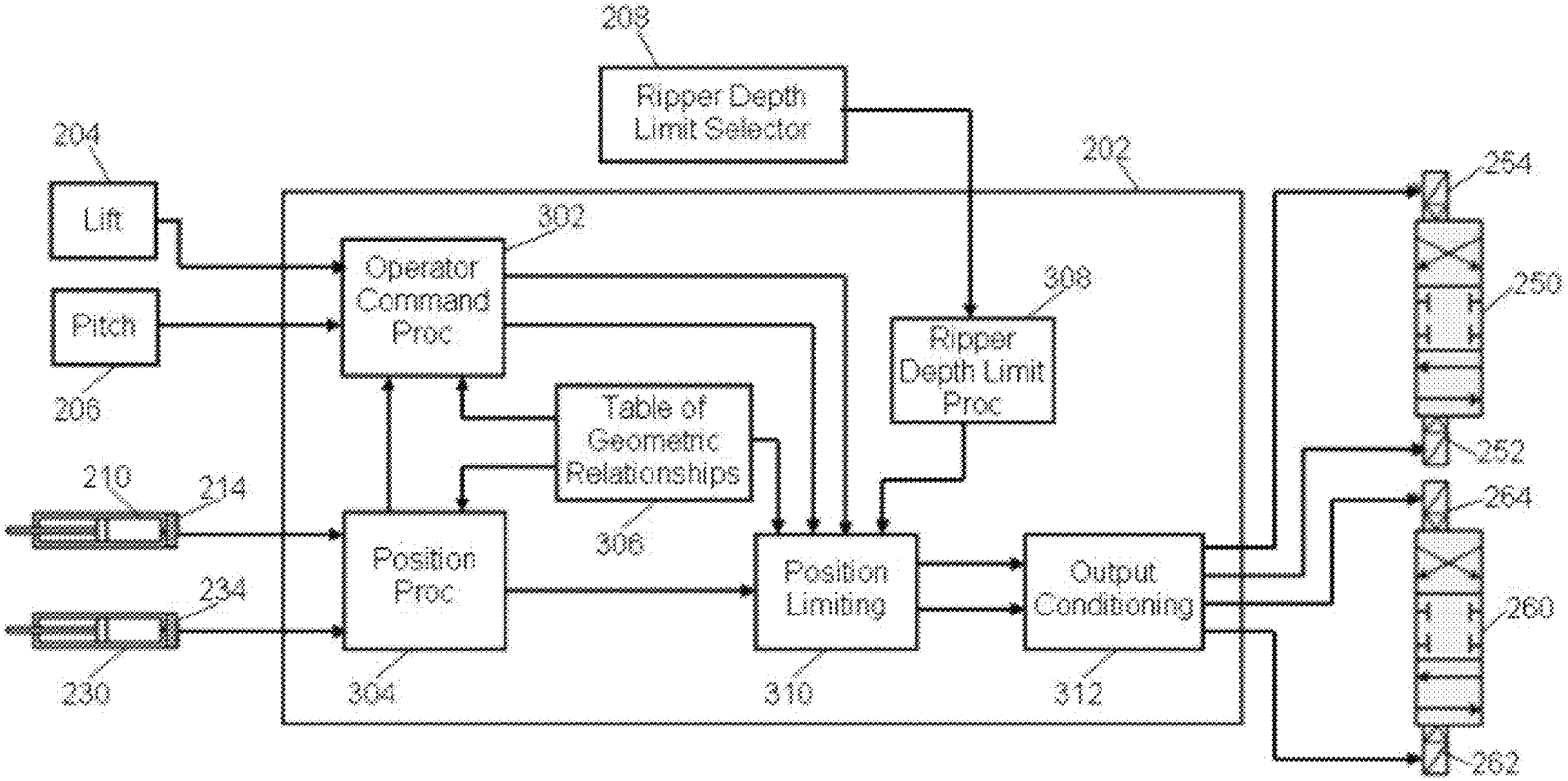
FIG. 3 illustrates a more detailed view of an exemplary embodiment of the EH controller that can be used in the EH system of FIG. 2.

FIG. 3 illustrates a more detailed view of an exemplary embodiment of the ripper EH controller 202. The ripper EH controller 202 includes a table of geometric relationships 306 which can be used to determine ripper position relative to the tractor based on system parameters including ripper lift and pitch cylinder positions. The inputs from the lift cylinder position sensor 214 and the pitch cylinder position sensor 234 are processed by a cylinder position processor 304 which also uses the table of geometric relationships 306 to determine ripper position data. The ripper position data computed by the position processor 304 is sent to an operator command processor 302 and to a position limiting processor 310.

The operator command processor 302 processes the ripper position data generated by the position processor 304, along with the inputs from the operator lift and pitch controllers 204, 206, and the table of geometric relationships 306 to generates lift cylinder commands and pitch cylinder commands. The lift and pitch cylinder commands are both sent to the position limiting processor 310.

The input from the ripper depth limit selector 208 is processed by a ripper depth limit processor 308 to generate a ripper depth limit command. The ripper depth limit command generated by the ripper depth limit processor 308 is sent to the position limiting processor 310.

The position limiting processor 310 processes the inputs from the operator command processor 302 and the ripper depth limit processor 308, and uses the table of geometric relationships 306 to determine lift and pitch cylinder commands to send to an output conditioning processor 312. If the ripper depth limit option is active, and the operator commands would cause the ripper to exceed the depth limit, then the position limiting processor 310 would modify the ripper lift and pitch commands to execute the operator commands without exceeding the depth limit.

The output conditioning processor 312 sends commands from the ripper EH controller 202 to the lift spool valve 250 and the pitch spool valve 260. The output conditioning processor 312 sends lift commands to the movement actuators 252, 254 to position the lift spool valve 250 and control the lift cylinders 210, 220. The output conditioning processor 312 sends pitch commands to the movement actuators 262, 264 to position the pitch spool valve 260 and control the pitch cylinders 230, 240.

Figure 4:
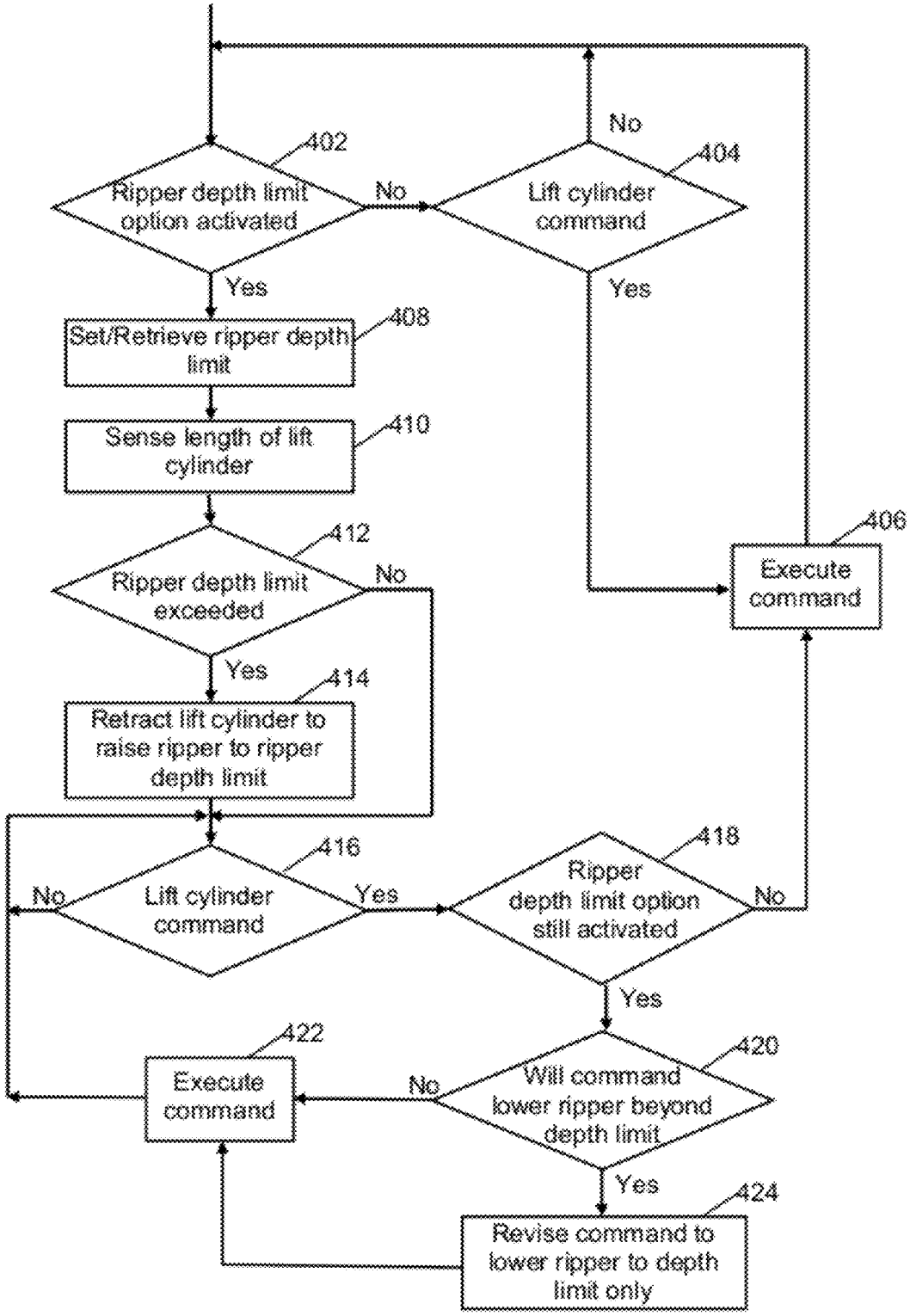
FIG. 4 is a flow diagram of an exemplary control process for a ripper depth limit system that uses sensor readings from the ripper lift cylinder(s)

FIG. 4 is a flow diagram of an exemplary implementation of a control process for the ripper depth limit that uses sensor readings from the lift cylinder(s) and not the pitch cylinder(s). When a command is processed, at block 402 the system checks if the ripper depth limit is activated. If the ripper depth limit is activated then control is passed to block 408, otherwise control is passed to block 404. At block 404, the system checks if the command is a lift cylinder command. If the command is a lift cylinder command then control is passed to block 406, otherwise the system returns to process the next command. At block 406, the system executes the lift cylinder command and then returns to process the next command.

If the ripper depth limit option is activated, then at block 408 the system retrieves and sets the ripper depth limit and then at block 410 the system checks the length of the ripper lift cylinder(s). Then at block 412, the system checks if the ripper depth limit is exceeded. If the ripper depth limit is exceeded then control is passed to block 414, otherwise control is passed to block 416. At block 414, the system retracts the ripper lift cylinders to raise the ripper to the ripper depth limit, and then passes control to block 416.

At block 416 the system waits for a lift cylinder command. When a lift cylinder command is received, control passes to block 418 where the system checks if the ripper depth limit option is still activated. If the ripper depth limit option is not still activated then at step 406 the lift cylinder command is executed and control is passed back to block 402 to wait for the depth limit option to be activated again. If the ripper depth limit option is still activated then control is passed to block 420.

At block 420 the system determines whether the lift command will lower the ripper beyond the depth limit. If the lift command will not lower the ripper beyond the depth limit then the lift cylinder command is executed at block 422, and control is passed back to block 416 to wait for the next lift cylinder command. If the lift command would lower the ripper beyond the depth limit then the lift cylinder command is revised at block 424 to only lower the ripper to the depth limit, the revised lift cylinder command is executed at block 422, and control is passed back to block 416 to wait for the next lift cylinder command.

Figure 5:
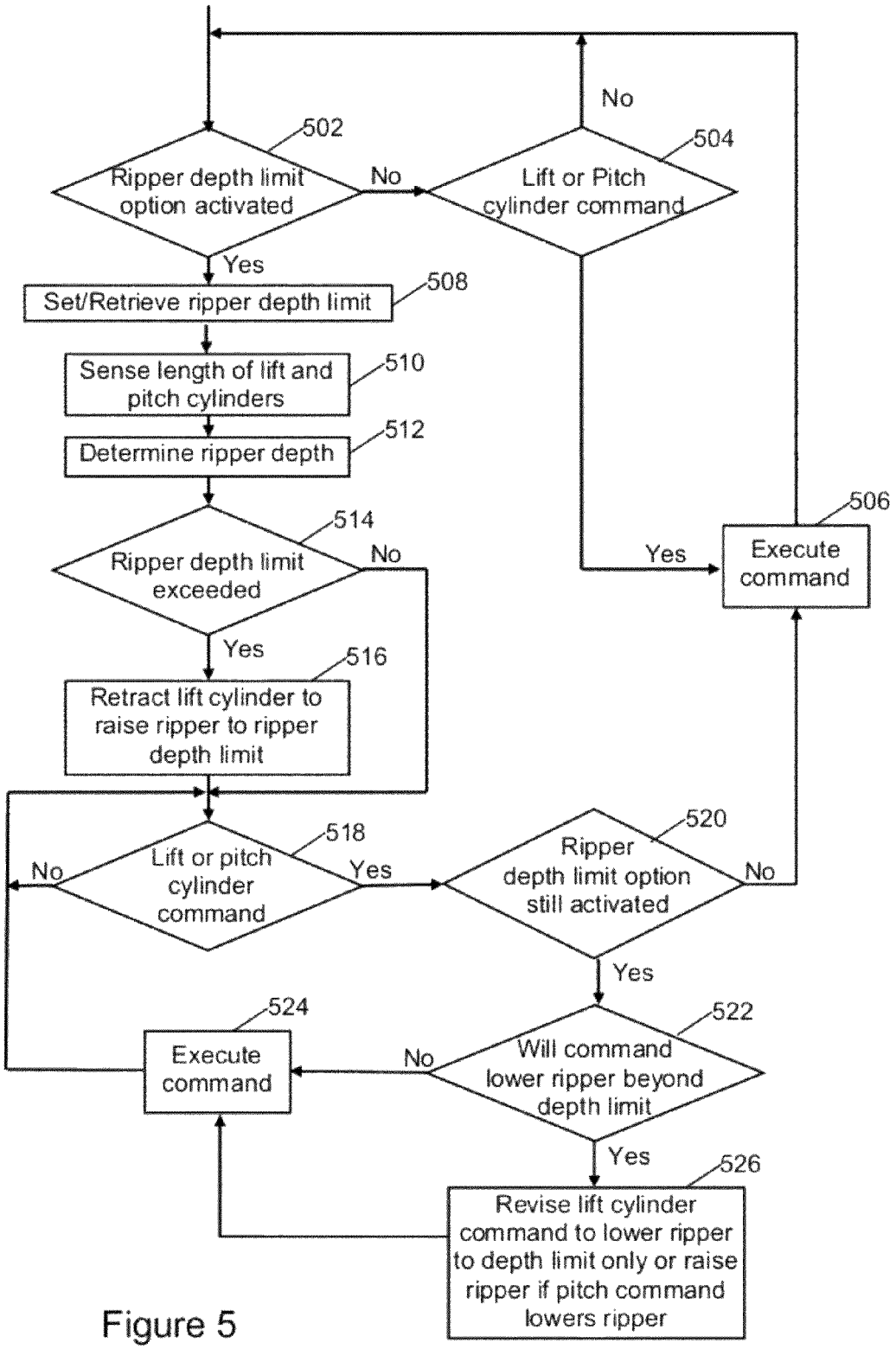
FIG. 5 is a flow diagram of an exemplary control process for a ripper depth limit system that uses sensor readings from the ripper lift and pitch cylinders.

FIG. 5 is a flow diagram of an exemplary implementation of a control process for the ripper depth limit that uses sensor readings from both the lift and pitch cylinders. When a command is processed, at block 502 the system checks if the ripper depth limit is activated. If the ripper depth limit is activated then control is passed to block 508, otherwise control is passed to block 504. At block 504, the system checks if the command is a ripper lift or pitch cylinder command. If the command is a ripper lift or pitch cylinder command then control is passed to block 506, otherwise the system returns to process the next command. At block 506, the system executes the ripper lift or pitch cylinder command, and then returns to process the next command.

If the ripper depth limit option is activated, then at block 508 the system retrieves and sets the ripper depth limit, then at block 410 the system checks the length of the ripper lift and pitch cylinders, and at block 512 the system determines the ripper depth. Then at block 514, the system checks if the ripper depth exceeds the ripper depth limit. If the ripper depth limit is exceeded then control is passed to block 516, otherwise control is passed to block 518. At block 516, the system retracts the ripper lift cylinders to raise the ripper to the ripper depth limit, and then passes control to block 518.

At block 518 the system waits for a ripper lift or pitch cylinder command. When a ripper lift or pitch cylinder command is received, control passes to block 520 where the system checks if the ripper depth limit option is still activated. If the ripper depth limit option is not still activated then at step 506 the ripper lift or pitch cylinder command is executed and control is passed back to block 502 to wait for the depth limit option to be activated again. If the ripper depth limit option is still activated then control is passed to block 522.

At block 522 the system determines whether the ripper lift or pitch command will lower the ripper beyond the depth limit. If the ripper lift or pitch command will not lower the ripper beyond the depth limit then the command is executed at block 524, and control is passed back to block 518 to wait for the next ripper lift or pitch cylinder command. If the ripper lift or pitch command would lower the ripper beyond the depth limit then the command is revised at block 526 to only lower the ripper to the depth limit or raise the ripper to the depth limit if the pitch command would lower the ripper beyond the depth limit. From block 526 control is passed to block 524 where the revised lift or pitch cylinder command is executed, and then control is passed back to block 518 to wait for the next ripper lift or pitch cylinder command.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains.

I claim:

1. A ripper depth limit system for a ripper that includes a ripper lift cylinder, the ripper depth limit system comprising:

an operator lift input generating an operator lift signal for controlling the raising and lowering of the ripper;

an operator ripper depth limit input for setting a ripper depth limit;

a lift cylinder sensor coupled to the ripper lift cylinder for sensing the position of the ripper lift cylinder and generating a lift cylinder position signal; and a ripper electro-hydraulic controller for processing the operator lift signal, the lift cylinder position signal and the ripper depth limit, and for generating and outputting ripper lift cylinder commands that do not allow the depth of the ripper to exceed the ripper depth limit.

2. The ripper depth limit system of claim 1, wherein the operator ripper depth limit input comprises an activation control for activating the ripper depth limit function, and a depth setting for setting the ripper depth limit.

3. The ripper depth limit system of claim 1, wherein the operator ripper depth limit input comprises a selector for selecting the ripper depth limit from a plurality of predefined depth limits.

4. The ripper depth limit system of claim 1, wherein the operator ripper depth limit input comprises a selector for selecting the ripper depth limit between a minimum ripper depth and a maximum ripper depth.

5. The ripper depth limit system of claim 1, wherein the ripper lift cylinder commands are output to a ripper lift spool valve controlling the raising and lowering of the ripper.

6. The ripper depth limit system of claim 1, wherein the ripper lift cylinder commands are output to an output conditioning processor, and the output conditioning processor outputs the conditioned ripper lift cylinder commands to a ripper lift spool valve controlling the raising and lowering of the ripper.

7. The ripper depth limit system of claim 1, wherein the ripper electro-hydraulic controller further comprises a position processor for determining a ripper position based on the lift cylinder position signal, and providing the ripper position for further processing by the ripper electro-hydraulic controller r.

8. The ripper depth limit system of claim 1, further comprising:

an operator pitch input generating an operator pitch signal for controlling the pitch of the ripper;

a pitch cylinder sensor coupled to a ripper pitch cylinder for sensing the position of the ripper pitch cylinder and generating a pitch cylinder position signal;

wherein the ripper electro-hydraulic controller further processes the operator pitch signal, the pitch cylinder position signal, and generates and outputs ripper pitch cylinder commands that do not allow the depth of the ripper to exceed the ripper depth limit.

9. The ripper depth limit system of claim 8, wherein the ripper lift cylinder commands are output to a ripper lift spool valve controlling the raising and lowering of the ripper, and the ripper pitch cylinder commands are output to a ripper pitch spool valve controlling the pitch of the ripper.

10. The ripper depth limit system of claim 8, wherein the ripper lift and pitch cylinder commands are output to an output conditioning processor; and the output conditioning processor outputs the conditioned ripper lift cylinder commands to a ripper lift spool valve controlling the raising and lowering of the ripper, and the conditioned ripper pitch cylinder commands to a ripper pitch spool valve controlling the pitch of the ripper.

11. The ripper depth limit system of claim 8, wherein the ripper electro-hydraulic controller further comprises a position processor for determining a ripper position based on the lift and pitch cylinder position signals, and providing the ripper position for further processing by the ripper electro-hydraulic controller.

12. A ripper depth limit method for controlling a ripper coupled to a lift cylinder that raises and lowers the ripper, the ripper depth limit method comprising:

setting a ripper depth limit;

reading a lift cylinder position from a sensor coupled to the lift cylinder;

determining a ripper position using the lift cylinder position reading;

receiving a ripper lift cylinder command from an operator control device;

determining whether executing the ripper lift cylinder command will cause the ripper to exceed the ripper depth limit;

when the ripper lift cylinder command will not cause the ripper to exceed the ripper depth limit, executing the ripper lift cylinder command;

when the ripper lift cylinder command will cause the ripper to exceed the ripper depth limit, revising the ripper lift cylinder command to not cause the ripper to exceed the ripper depth limit and executing the revised ripper lift cylinder command; and returning to receive another ripper lift cylinder command.

13. The ripper depth limit method of claim 12, further comprising, after the determining a ripper position step and before the receiving a ripper lift command step:

determining whether the ripper position exceeds the ripper depth limit; and when the ripper position exceeds the ripper depth limit, generating a ripper lift command to raise the ripper to the ripper depth limit.

14. The ripper depth limit method of claim 12, further comprising, after receiving a ripper lift cylinder command:

determining whether the ripper depth limit functionality is still activated; and when the ripper depth limit functionality is not still activated, executing the ripper lift cylinder command and exiting the ripper depth limit method.

15. The ripper depth limit method of claim 12, wherein setting a ripper depth limit comprises:

reading one of a plurality of predefined depth limit values from a depth limit selector.

16. The ripper depth limit method of claim 12, wherein setting a ripper depth limit comprises:

determining a position of a selector between a minimum and maximum value; and determining the ripper depth limit based on the position of the selector.

17. A ripper depth limit method for controlling a ripper coupled to a lift cylinder that raises and lowers the ripper and a pitch cylinder the controls the pitch of the ripper, the ripper depth limit method comprising:

setting a ripper depth limit;

reading a lift cylinder position from a lift sensor coupled to the lift cylinder;

reading a pitch cylinder position from a pitch sensor coupled to the pitch cylinder;

determining a ripper position using the lift and pitch cylinder position readings;

receiving a ripper lift or pitch cylinder command from an operator control device;

determining whether executing the ripper lift or pitch cylinder command will cause the ripper to exceed the ripper depth limit;

when the ripper lift or pitch cylinder command will not cause the ripper to exceed the ripper depth limit, executing the ripper lift or pitch cylinder command; and when the ripper lift or pitch cylinder command will cause the ripper to exceed the ripper depth limit, revising the ripper lift or pitch cylinder command to not cause the ripper to exceed the ripper depth limit and executing the revised ripper lift or pitch cylinder command;

returning to receive another ripper lift or pitch cylinder command.

18. The ripper depth limit method of claim 17, further comprising, after the determining a ripper position step and before the receiving a ripper lift or pitch cylinder command step:

determining whether the ripper position exceeds the ripper depth limit; and when the ripper position exceeds the ripper depth limit, generating a ripper lift command to raise the ripper to the ripper depth limit.

19. The ripper depth limit method of claim 17, further comprising, after receiving a ripper lift or pitch cylinder command:

determining whether the ripper depth limit functionality is still activated; and when the ripper depth limit functionality is not still activated, executing the ripper lift or pitch cylinder command and exiting the ripper depth limit method.

20. The ripper depth limit method of claim 17, wherein revising the ripper lift or pitch cylinder command to not cause the ripper to exceed the ripper depth limit comprises:

when the ripper lift or pitch cylinder command is a ripper lift cylinder command, revising the ripper lift cylinder command to lower the ripper to the ripper depth limit only; and when the ripper lift or pitch cylinder command is a ripper pitch cylinder command, generating and executing a ripper lift cylinder command to raise the ripper and executing the ripper pitch cylinder command so the ripper does not exceed the ripper depth limit.

* * * * *